US005707561A

United States Patent [19]

Swanson

[11] Patent Number: 5,707,561

[45] Date of Patent: Jan. 13, 1998

[54] TAMPER RESISTANT CARBURETOR NEEDLE VALVE ADJUSTMENT LIMITER

[75] Inventor: Mark S. Swanson, Cass City, Mich.

[73] Assignee: Walbro Corporation, Cass City, Mich.

[21] Appl. No.: 683,817

[22] Filed: Jul. 18, 1996

[51] Int. Cl.[6] ..... F02M 3/08

[52] U.S. Cl. ..... 261/71; 261/DIG. 38; 261/DIG. 84; 137/382

[58] Field of Search ..... 261/71, DIG. 38, 261/DIG. 84; 137/382

[56] References Cited

U.S. PATENT DOCUMENTS

| | | | |
|---|---|---|---|
| 3,618,906 | 11/1971 | Charron | 261/41 |
| 4,246,929 | 1/1981 | Wakeman | 261/DIG. 84 |
| 4,308,220 | 12/1981 | Tateno | 261/DIG. 84 |
| 5,055,238 | 10/1991 | Araki | 261/35 |
| 5,236,634 | 8/1993 | Hammett et al. | 137/382 |
| 5,252,261 | 10/1993 | Gerhardy | 261/DIG. 38 |
| 5,322,645 | 6/1994 | Hammett et al. | 261/71 |
| 5,603,869 | 2/1997 | McNew et al. | 261/DIG. 84 |

FOREIGN PATENT DOCUMENTS 61-13455 8/1986 Japan .

*Primary Examiner*—Tim R. Miles

*Attorney, Agent, or Firm*—Barnes, Kisselle, Raisch, Choate, Whittemore & Hulbert

[57] ABSTRACT

A limiter of the extent of adjustment of a fuel metering needle valve of a carburetor for an internal combustion engine. The limiter has a housing with a passage in which the head end of the needle valve is received and a cap received in the passage on the head end of the valve for rotation in unison with the valve. An arm carried by the body of the cap is engagable with a stop in the passage to limit to less than one complete revolution the extent to which the cap and needle valve can be rotated by an end user to adjust the needle valve. To provide a tamper-resistant limiter, the head of the cap is received in a bore of the housing passage with either only a slight clearance between them or an interference fit which also inhibits rotation of the valve by vibration of the operating engine on which the carburetor and limiter are utilized. Preferably, a non-circular recess in the head of the cap is constructed to receive the blade of a tool, such as a screw driver, to facilitate manually rotating the cap and the needle valve in unison within the limits provided by the arm and stop to permit only limited adjustment of the needle valve by an end user.

14 Claims, 2 Drawing Sheets

TAMPER RESISTANT CARBURETOR NEEDLE VALVE ADJUSTMENT LIMITER

FIELD OF THE INVENTION

This invention relates to carburetors for internal combustion engines and more particularly to a limiter of the rotational adjustment of a fuel flow metering valve of a carburetor.

BACKGROUND

In response to relatively recent federal and state "clean air" regulations, carburetor limiter caps have been used to restrict carburetor fuel flow metering valve adjustment to prevent the excessive emission of carbon monoxide and unburned hydrocarbons from internal combustion engine. Primarily, limiters have been used with conventional float bowl carburetors to control automobile exhaust emissions. More recently their use has been extended to diaphragm-type carburetors in small engines simply to prevent gross misadjustment of fuel flow. However, future emissions regulations are expected to extend the role of limiter caps to control small engine emissions.

Fuel flow within a carburetor is commonly metered during no load or idle engine operation by a first "idle" needle valve and during part or full load operation by a second "main" needle valve. Typically, each valve has a threaded shank with an enlarged knurled head at one end and a conical or needle shaped valve control surface at the opposite end which is received within an opening in the carburetor body. To calibrate fuel flow, each valve is rotatively adjusted to axially extend or retract the valve control surface within a fuel passage in the carburetor until optimum fuel flow through the passage is achieved. Pre-calibration of the carburetor on a flow test bench may be performed prior to being assembled to an engine. After assembly of the carburetor to an engine, it is customary to adjust the metering valves, if needed, to fine tune fuel flow to the actual demand of the operating engine. Subsequent over adjustment of fuel flow is discouraged by affixing a limiter cap over the head of each valve.

These limiter caps generally consist of a cylindrical body having an opening at one end for axially receiving the valve head in tight fitting engagement for rotation of both in unison. A recess in the opposite end of the cap is provided to enable an adjustment tool to engage the valve directly or the cap alone to rotate both in unison to make fuel flow adjustments. Projecting radially outwardly from the cap body is an arm for abutting against a fixed stop extending from the carburetor to limit valve rotation. Representative limiter caps are described in U.S. Pat. No. 3,618,906 Charron and U.S. Pat. No. 5,055,238 Araki.

Stop members such as an integrally cast projection of the carburetor or the body of another cap press-fit on an adjacent needle valve may be used to limit valve and cap rotation and hence adjustment. Similarly, Japanese Patent Publication Jitsuko Sho 61-134555, discloses a hollow cylindrical collar limiter which has an outwardly extending arm for abutting directly against the head of an adjacent valve to limit adjustment.

U.S. Pat. No. 5,332,645 discloses a cap for limiting the range of adjustment of a carburetor fuel flow metering valve in which the cap has a body and an arm projecting radially outwardly thereof to abut against a stop carried by an adjacent metering valve. The cap has a passage for telescopically axially receiving the head end of the shank of the valve and portions within the passage enable the cap to be retained on the valve in a freely rotating first position during assembly and in a second position securing the cap to the valve to limit adjustment of it. The cap may also be moved to a third position to releasably drivably engage the valve to perform fuel flow adjustment before securing the cap to the valve.

There is a need for a tamper-proof limiter construction preventing removal of the limiter cap by an end user or operator of an engine so that its fuel flow cannot be improperly over adjusted after the carburetor has been fine tuned to the engine by the engine manufacturer. For example, if the metering valve of a carburetor on a two-stroke engine is over adjusted by an operator or user, the emissions could be substantially increased so that they no longer comply with specifications and/or legally mandated requirements, or fuel flow could be decreased sufficiently to deprive the engine of sufficient lubrication entrained in the fuel which would lead to overheating or catastrophic engine failure.

SUMMARY OF THE INVENTION

A tamper-proof limiter of the range of user adjustment of a fuel flow metering valve in a carburetor. The limiter has a cap received in a pocket of a housing carried by the carburetor and surrounding the cap and the head end of the metering valve which projects from the carburetor body. The cap has a body with a recess pressed with an interference fit on the head of the metering valve and a head received in a bore of the passage and opening to the exterior of the housing. An arm on the body is engagable with a stop in the passage to limit the extent of rotation in unison of both the cap and the needle valve when the cap is received on the valve. The head has a circular portion adjacent the free end of the cap which lies in close proximity with the bore of the passage to prevent engagement and removal of the cap and a recess in the exposed face of the head for receiving a tool for limited rotation of the cap and the valve in unison for adjustment of the valve by the end user. In one form the housing may be integral with the body of the carburetor and in another form may be a separate piece carried by the carburetor and preferably retained by the needle valve and an anti-rotation spring. If desired, the head of the cap may have a firm frictional fit with the bore of the housing to inhibit rotation of the needle valve due to vibration of an operating engine so that no anti-rotation spring is needed. This firm frictional engagement will still permit intentional rotation by an end user of the limiter cap within predetermined limits to adjust the needle valve.

Typically, without any cap thereon the needle valve is both precalibrated in a bench flow test of the carburetor and subsequently after the carburetor is assembled to an engine, the needle valve is adjusted to fine tune fuel flow to the actual demand of the operating engine. Thereafter, the limiter cap is axially aligned with the head of the needle valve, angularly rotated to dispose the arm in the desired position relative to the stop in the housing passage and then axially advanced to force the recess in the cap over the head of the valve with a firm interference fit to permanently mount the cap on the valve and dispose its head within the passage.

Objects, features and advantages of this invention are to provide a tamper-proof needle adjustment limiter which cannot be removed or defeated by an end user, restricts adjustment of the valve to prevent excessive engine emissions and damage to an operating engine, is readily and easily installed on a needle valve which has been fine tuned to a specific engine, may be simply and accurately positioned relative to a stop when securely mounting the cap on the valve head, permits limited fuel flow adjustment by a user to adequately adjust carburetor performance under a variety of operating conditions while preventing over adjustment of fuel flow, and is extremely simple, rugged, durable, reliable, easy to assemble, of economical manufacture and assembly and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION

Figure 1:
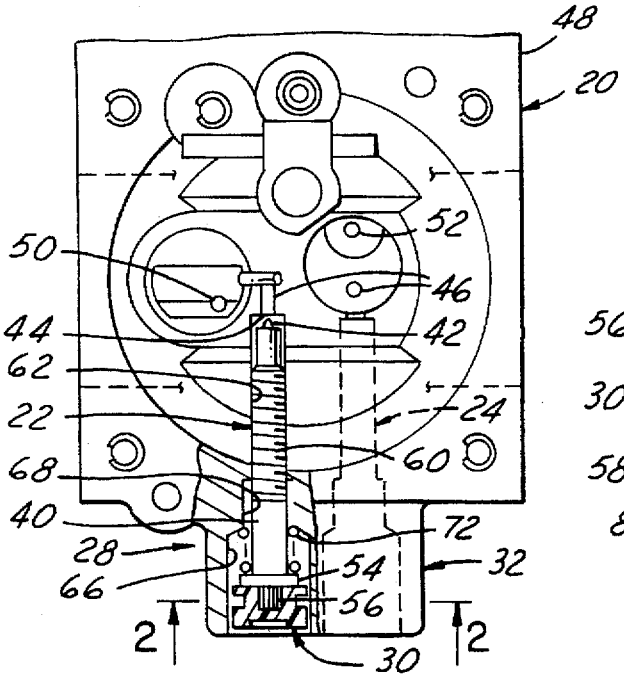
FIG. 1 is a fragmentary top view of a carburetor with portions broken away and in section illustrating a needle valve adjustment limiter embodying this invention.
Figure 2:
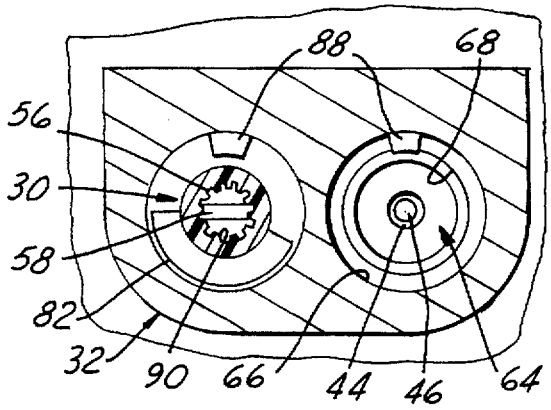
FIG. 2 is a fragmentary sectional view taken generally on line 2—2 of FIG. 1.

Referring in more detail to the drawings, FIGS. 1 and 2 illustrate a carburetor 20 with idle and main needle valves 22 and 24 for varying and adjusting the fuel flow rate during low and high speed operation respectively of an internal combustion engine on which the carburetor is utilized. Typically, the carburetor is used on a two-stroke or four-stroke small engine utilizing gasoline as its fuel. The extent to which each needle valve 22 & 24 can be rotated by an end user to adjust it is limited or restricted by a limiter 28 embodying this invention with a cap 30 carried by each needle valve and an associated housing 32 in which the cap is received. Since the needle valves, caps and associated housing have the same construction and arrangement for both idle and high speed fuel flow only one needle valve and limiter cap will be described in detail.

As shown in FIGS. 1 and 2, each needle valve 22 & 24 has an elongate generally cylindrical shank 40 with a conical valve control surface 42 at one end which cooperates with a complementary seat 44 and port 46 in the carburetor body 48 to vary and adjust the quantity of fuel which flows to the associated idle and main jets 50 & 52 during operation of the carburetor. Each needle valve has an integral flange 54 and a knurled head 56 adjacent the other end. To permit adjustment of the needle valve before the cap 30 is received on it, the valve head 56 has a slot 58 through it for receiving the blade of a tool, such as a screw driver, for rotating the needle valve. To secure the needle valve in the carburetor body 48 and permit adjustment of fuel flow by axial displacement of its conical tip 42 relative to its associated seat, the valve shank 40 has a plurality of threads 60 on its outer periphery which engage with a complementarily threaded bore 62 in the carburetor body. The head end of the valve projects into a surrounding pocket 64 formed by a bore 66 and a counterbore 68 in the housing 32 which may be integral with the carburetor body 48. To prevent the needle valve from being rotated due to vibration of the operating engine on which the carburetor is utilized, a compression spring 72 is received over the shank of the needle valve and bears on both its flange 54 and the housing 32.

Figure 5:
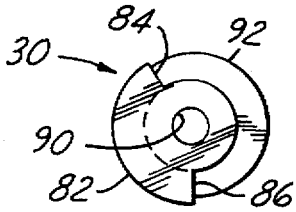
FIG. 5 is an end view of the other end of the limiter cap of FIG. 3.
Figure 3:
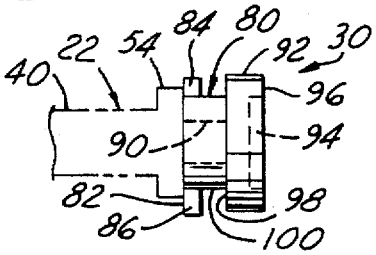
FIG. 3 is a fragmentary side view of the limiter cap received on the needle valve of FIG. 1.
Figure 4:
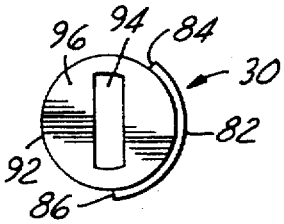
FIG. 4 is an end view of the head end of the limiter cap of FIG. 3.

As shown in FIGS. 3–5, each limiter cap 30 has a body 80 with an arm 82 projecting radially therefrom and preferably having arcuately or anglarly spaced apart abutment surfaces 84 & 86 engagable with a stop 88 in the housing pocket 64 for limiting rotation and hence adjustment of the needle valve on which the cap is received. The abutment surfaces 84 and 86 limit rotation of the cap and needle valve to less than one complete revolution or 360°. The limiter can be designed for any specific extent of limited rotation over a wide range by selecting an appropriate angular spacing between the abutment surfaces 84 & 86 of the arm and/or the arcuate extent or angular width of the stop 88. For securing the cap 30 on the head 56 of the needle valve, the body has a coaxial recess or blind bore 90 having a smaller diameter than the diameter of the serrated valve head to provide an interference fit therewith when received thereon. At the other end of the body 80 the cap has a cylindrical head 92 with an elongate rectangular slot 94 in its outer end face 96 for receiving a blade of a tool, such as a screw driver, to permit an end user of the carburetor 20 to manually rotate within limits the needle valve on which the cap 30 is received to adjust the valve.

As shown in FIGS. 1 and 2, to provide a tamper-proof limiter 28 in which the cap 30 cannot be removed by an end user of the carburetor on an engine, in assembly, the entire cap 30 is received in the pocket 64 of the housing with the head 92 of the cap having a close fit with the bore 66 of the pocket 64 and preferably only a slight clearance between them. This slight clearance will permit removal of the cap during manufacture of the carburetor or by authorized service personnel by utilizing a special tool with fingers slidably received in the clearance and engaging a shoulder 98 formed by the recess 100 behind the cap or the arm 82.

Figure 6:
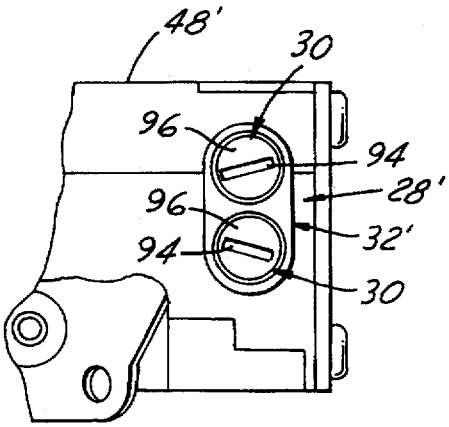
FIG. 6 is a fragmentary side view of a modified form of a limiter embodying this invention.
Figure 7:
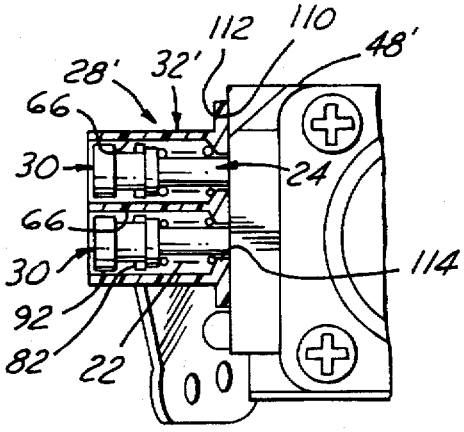
FIG. 7 is a fragmentary top view of the limiter of FIG. 6.

FIGS. 6 and 7 illustrate a modified limiter 28' embodying this invention which is substantially the same as the limiter 28 of FIGS. 1–5 except that the needle valves 22 & 24 and caps 30 are received in a housing 32' which is a separate body or piece from the carburetor body 48'. The separate housing 32' has a generally planar inner face 110 which in assembly bears on a complementary mounting face 112 on the carburetor body 48'. The housing is retained on the carburetor body by the needle valves 22 & 24 the shanks 40 of which pass through holes 114 in the base of the housing. The housing 32' is yieldably urged into engagement with the carburetor by the springs 72 received in the pockets 64 and between the housing 32' and the flange 54 of each needle valve.

Figure 8:
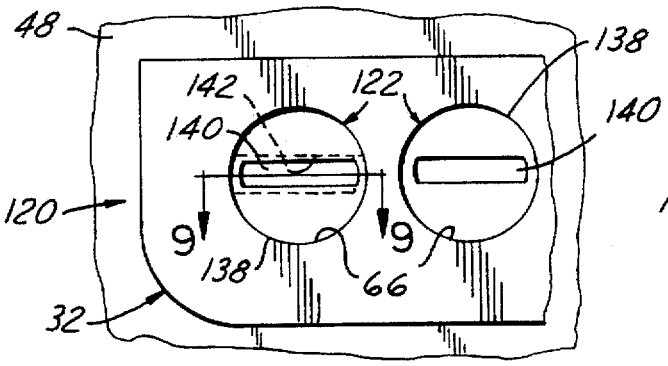
FIG. 8 is fragmentary end view of another embodiment of a limiter embodying this invention.
Figure 9:
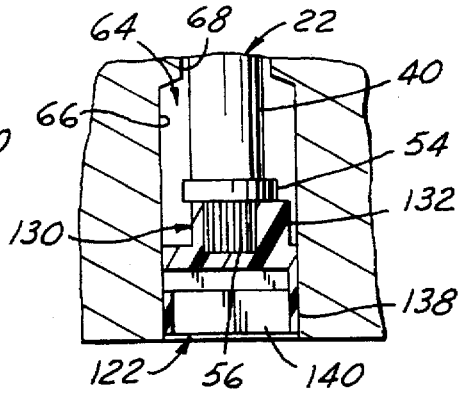
FIG. 9 is a fragmentary sectional view taken generally on line 9—9 of FIG. 8 and illustrating a modified limiter cap mounted on the head of a needle valve and received in a passage in a housing carried by a carburetor.
Figure 10:
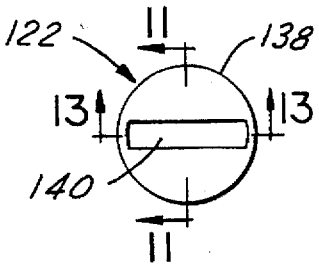
FIG. 10 is an end view of the head end of the limiter cap of FIG. 8.

FIGS. 8 and 9 illustrate the carburetor 20 with the extent of rotation of the idle and main needle valves 22 and 24 for adjusting fuel flow being limited or restricted by a limiter 120 embodying this invention. The limiter 120 has a cap 122 which is carried by each needle valve 22 and 24 and received in a pocket 64 of the associated housing 32.

Figure 11:
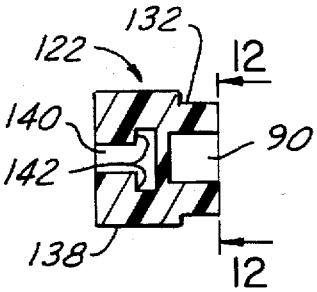
FIG. 11 is a sectional view of the limiter cap taken generally on line 11—11 of FIG. 10.
Figure 12:
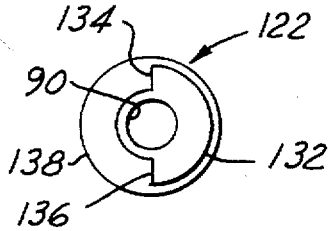
FIG. 12 is an end view of the other end of the limiter cap of FIG. 10.
Figure 13:
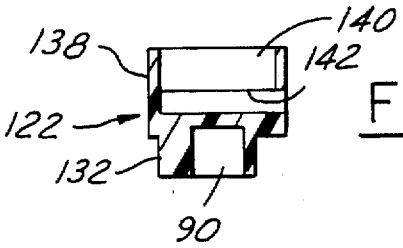
FIG. 13 is a sectional view taken on line 13—13 of FIG. 10.

As shown in FIGS. 9 & 12 the cap 122 has a body 130 with a radially projecting arm 132 with abutment surfaces 134 & 136 engagable with the stop 88 in the housing to limit rotation of the needle valve on which the cap is received. Adjacent the outer end the cap has a cylindrical head 138 with a recess or slot 140 in its outer end face for receiving the blade of a tool, such as a screw driver, to manually rotate the cap to permit manual adjustment within predetermined limits of the needle valve by an end user of the engine on which the carburetor is received. Preferably, to facilitate removal of the cap from the needle valve, either during manufacture or by authorized service personnel, the slot 140 has in cross section a generally T-shape as shown in FIG. 11 with shoulders 142 which are engagable by the fingers of a special removal tool which are inserted generally axially into the slot 140 and moved radially for engagement with the shoulders 142 for removing the cap from the valve head. To facilitate forming the slot 140 when injection molding the cap of a plastic material, the bottom portion preferably extends radially at one end through the side wall of the head (as shown in FIGS. 9 and 13), to accomodate a movable core in the die used for injection molding the cap.

As shown in FIGS. 8 and 9, to provide both a tamper-proof limiter 120 in which the cap 122 cannot be removed from its associated needle valve by the end user, and to prevent rotation of the needle valve by vibration of the operating engine on which the carburetor and limiter are utilized, the maxim tan diameter of the head 138 of the cap is larger than the diameter of the bore 66 in the housing surrounding the cap so that in assembly the cap has an interference fit with the housing. This interfrence fit provides sufficient fictional resistance to rotation of the cap and its associated valve that an anti-rotation spring is not needed to prevent rotation of the valve by vibration of the operating engine. This interference fit does not prohibit intentional rotation of the cap and its associated valve by an end user to adjust the valve within the limits provided by the arm 132 of the cap and its associated stop 88. This interference fit eliminates the need for a compression spring to inhibit unintentional rotation of the needle valve by vibration of the operating engine on which the carburetor and limiter are used.

Preferably, the limiter caps are of one piece, unitary construction for simpleness and ease of manufacture and are constructed from a generally homogenous plastic material such as nylon and preferably Zytel or Minlon, nylon formulations which are registered trademarks of E.I. Du Pont De Nemours and Company, a polyoxymethylene thermoplastic such as Delrin which is also a Du Pont material, or other high temperature thermoplastic materials. A cap constructed of any of these materials is strong and resilient and able to deform around the knurls of the valve head to more positively frictionally secure the cap to the valve while resisting brittle fracture if tampered with. More generally, however, the caps could also be composed of a phenolic, polyurethane, polyacrylic, rubber or other plastic material.

Typically, with these limiters 28, 28' and 120, before the caps 30 and 122 are installed on the needle valve of a carburetor, the carburetor is bench flow tested to make a gross flow rate adjustment of the needle valves 22 and 24 to provide the approximate flow rate desired for engines of the type on which the carburetor will be used. Thereafter, the carburetor is mounted on the specific engine with which it will be used in the field and the needle valves are further adjusted by rotating them to fine tune the fuel flow rate of the carburetor for its best match with the specific operating engine and typically to achieve desired or mandatory exhaust emission standards. After this fine tuning is completed, the limiter caps 30 or 122 are installed on the needle valves. Each cap is installed by generally coaxially aligning it with a needle valve, angularly orienting and positioning the arm of the cap relative to its associated stop 88, and then axially advancing the cap to force its recess 90 over and into firm engagement with the head 56 of the needle valve, preferably with an interference fit, which both secures the cap on the valve for rotation in unison therewith and disposes the cap in the pocket 64 associated with the valve so that it cannot be removed by an end user of the engine with the carburetor and limiters thereon.

What is claimed is:

1. A limiter of the adjustment of a fuel flow valve having a shank with a head end projecting from the body of a carburetor comprising: a housing carried by the carburetor body and having a pocket with a bore bounded by a circular and circumferentially continuous sidewall portion and opening to the exterior of the housing and receiving the head end of the valve in the pocket and generally coaxially with the circular sidewall portion of the bore, at least one stop in the pocket, and a cap having a body which is engagable with the head of the valve for rotation in unison with the valve, a head received in the bore of the housing and having a circular and circumferentially continuous sidewall peripheral portion having at least a close radial fit with the circular sidewall portion of the bore of the housing, and an arm having circumferentially spaced apart abutment surfaces engagable with the stop to limit to less than one complete revolution the extent of rotation of the cap and the valve on which it is received, and the circular sidewall of the head of the cap being generally coaxial with the axis of rotation of the shank of the valve and disposed axially outward of and overlapping the arm and the stop and axially within the circular sidewall portion of the bore.

2. The limiter of claim 1 wherein the circular sidewall portion of the head of the cap has an interference fit with the circular sidewall portion of the bore of the housing to inhibit unintentional rotation of the cap and valve relative to the carburetor body.

3. The limiter of claim 1 wherein the body of the cap has a recess having an interference fit with the head of the valve and is press-fit thereon and is carried by the valve.

4. The limiter of claim 3 which also comprises a plurality of serrations on the periphery of the head of the valve which are received with an interference fit in the recess of the head of the cap.

5. The limiter of claim 1 wherein the housing is integral with and part of the carburetor body.

6. The limiter of claim 1 wherein the housing is a separate piece from the carburetor body and has a hole through which the shank of the valve passes, and a spring is received in the pocket and bears on the valve and the housing and urges the housing into engagement with the carburetor body.

7. The limiter of claim 1 wherein the head of the cap has a non-circular recess in an end face thereof exposed to the exterior of the housing which is constructed to receive the blade of a tool for rotating within predetermined limits the cap and the valve in unison to adjust the valve.

8. The limiter of claim 7 wherein the non-circular recess in the face of the head of the cap has in cross section a generally T-shape configuration providing a shoulder which may be engaged by a tool for removing the cap from the valve.

9. The limiter of claim 1 wherein the arm of the cap does not project radially outwardly of the periphery of the head of the cap.

10. The limiter of claim 1 wherein at least a portion of the periphery of the head of the cap has a close fit with the bore of the pocket of the housing with only a slight clearance between them.

11. The limiter of claim 10 wherein the body of the cap has a recess behind the head forming a shoulder which may be engaged by a tool inserted between the head of the cap and the housing for removing the cap from the valve and the passage in the housing.

12. The limiter of claim 1 wherein the body, head and arm of the cap are of one homogenous piece of plastic material.

13. The limiter of claim 12 wherein the plastic material is one of nylon and polyoxymethylene.

14. The limiter of claim 1 wherein the body, head and arm of the cap are of one homogenous piece of a thermoplastic material.

* * * * *